US011920889B2

(12) United States Patent
Hong et al.

(10) Patent No.: US 11,920,889 B2
(45) Date of Patent: Mar. 5, 2024

(54) TOY FIREARM INCORPORATING A REPLACEABLE CARTRIDGE WITH BB BULLETS

(71) Applicant: GUNPOWER CORPORATION, Jeollabuk-do (KR)

(72) Inventors: Young Pyo Hong, Jeollabuk-do (KR); Sung June Yoo, Jeollabuk-do (KR); Kyoung Ki Yang, Jeollabuk-do (KR)

(73) Assignee: GUNPOWER CORPORATION, Jeollabuk-Do (KR)

( * ) Notice: Subject to any disclaimer, the term of this patent is extended or adjusted under 35 U.S.C. 154(b) by 0 days.

(21) Appl. No.: 17/943,295

(22) Filed: Sep. 13, 2022

(65) Prior Publication Data

US 2023/0417508 A1 Dec. 28, 2023

(30) Foreign Application Priority Data

Jun. 24, 2022 (KR) ..... 10-2022-0077248

(51) Int. Cl.

| | |
|---|---|
| ***F41B 11/00*** | (2013.01) |
| ***F41B 11/62*** | (2013.01) |
| ***F41B 11/71*** | (2013.01) |
| ***F41B 11/723*** | (2013.01) |
| *F41A 33/00* | (2006.01) |

(52) U.S. Cl.

CPC ..... *F41B 11/723* (2013.01); *F41B 11/62* (2013.01); *F41B 11/71* (2013.01); *F41A 33/00* (2013.01)

(58) Field of Classification Search

CPC ..... F41B 11/723; F41B 11/64; F41B 11/62; F41B 11/71; F41B 11/89; F41B 11/54; F41A 33/00

USPC ..... 124/66, 73, 78, 56

See application file for complete search history.

(56) References Cited

U.S. PATENT DOCUMENTS

| | | | | |
|---|---|---|---|---|
| 3,780,720 | A * | 12/1973 | Alderson | F41B 11/723 124/31 |
| 4,362,145 | A * | 12/1982 | Stelcher | F41A 33/00 124/58 |
| 8,578,922 | B1 * | 11/2013 | Granger | F41B 11/723 124/71 |
| 2010/0307472 | A1 * | 12/2010 | Witzigreuter | F41B 11/681 473/569 |
| 2019/0301843 | A1 * | 10/2019 | Hammond | F42B 8/00 |
| 2022/0178648 | A1 * | 6/2022 | Seegers | F41B 11/682 |

FOREIGN PATENT DOCUMENTS

KR 10-2058213 B1 12/2019

* cited by examiner

*Primary Examiner* — Michael D David

(74) *Attorney, Agent, or Firm* — The PL Law Group, PLLC

(57) ABSTRACT

A toy firearm includes: a hollow firearm body; a cartridge module separably coupled in front of the firearm body to store a plurality of BB bullets to be fired; a gas discharge module to supply introduced gas to the BB bullets stored in the cartridge module by sequential control using a solenoid valve; an electrical sound module electrically connected to the gas discharge module to generate an electrical high voltage sound for a predetermined time with respect to a point in time of firing the BB bullets stored in the cartridge module; and a gas tank disposed in a grip of the firearm body to temporarily store the gas and supply the stored gas to the gas discharge module, wherein the cartridge module includes a pair of barrels arranged side by side at a predetermined angle along front and rear sides.

6 Claims, 8 Drawing Sheets

(b)

(a)

TOY FIREARM INCORPORATING A REPLACEABLE CARTRIDGE WITH BB BULLETS

CROSS-REFERENCE TO RELATED APPLICATION AND CLAIM OF PRIORITY

This application claims the benefit under 35 USC § 119 of Korean Patent Application No. 10-2022-0077248, filed on Jun. 24, 2022, in the Korean Intellectual Property Office, the entire disclosure of which is incorporated herein by reference for all purposes.

BACKGROUND

1. Technical Field

The present disclosure relates to a toy firearm with a replaceable cartridge loaded with BB bullets, and more particularly, to a toy firearm structure in which a replaceable cartridge loaded with BB bullets is mounted after an electric shock device is removed, and in case of a BB bullet fired up, a cam and a vibration plate are mounted so that a vibration module simulates an electrical high voltage firing situation in which a high voltage is delivered for a predetermined time after firing.

2. Background Art

In general, a taser gun is a tool used by police to control people who need to be subdued. The taser gun has a range of 5 to 6 meters, and two electrodes (electric probes) attached to electrical wires carry a 50,000 volt-electric current, and since the taser gun fires the two electrodes at the same time, it is referred to as an electroshock weapon, and when the electric probes strike a target, the electric shock temporarily disrupts the target's central nervous system and the target will fall to the ground.

According to the operating mechanism of the taser gun, when the trigger is pulled, compressed nitrogen in the cartridge expands and the two pins connected to the cartridge with the electrical wires are expelled, and when the two pins hit a target, an electric current of pulses of 2 to 3 mAh similar to signals is delivered to the central nervous system for 5 seconds, causing contraction of muscles in the whole body, leading to incapacitation.

To fire the taser gun, the two electrodes and the cartridge including compressed nitrogen are necessary, and since the cartridge is disposable, it is necessary to replace the cartridge every shot. The electrodes are wiredly connected to the body, and moving a safety device down within 5 seconds stops the electric current, and after firing, pulling the trigger again allows the electric current to flow again. Additionally, the fired electrode probes exert their effects when inserted into the target's skin.

Meanwhile, to properly use the taser gun in emergency, for example, when arresting suspects, taser gun training is necessary in normal circumstances, but the high cost of compressed nitrogen hinders frequent training in normal circumstances.

That is, there is currently no particular taser gun training method and training is actually conducted by firing every single bullet at a mannequin, and the high cost of shooting costing approximately 30,000 to 50,000 KRW per bullet hinders proficiency training.

SUMMARY

The present disclosure provides a toy firearm having a module which fires 6 mm BB bullets as projectiles.

The present disclosure provides a toy firearm structure in which a replaceable cartridge loaded with BB bullets is mounted after an electric shock device is removed, and in case of a BB bullet fired up, a cam and a vibration plate are mounted so that a vibration module simulates an electrical high voltage firing situation in which a high voltage is delivered for a predetermined time after firing.

The present disclosure significantly reduces the shooting cost considering a situation in which high shooting cost prohibits frequent training, thereby improving shooting skills through more shooting training.

The present disclosure makes it possible to conduct shooting training through images using, as a target, a monitor which detects a point of impact of a BB bullet, not a mannequin, thereby achieving a personal shooting training using a narrow space such as an indoor space.

The present disclosure can adjust the bullet velocity and control simultaneous firing and sequential firing by the control of BB bullet firing data and firing and the adjustment of the extent to which an electronic solenoid is open or closed through a wireless method.

The present disclosure can be used to detect a point of impact after firing at a target in training wear using paintball 6 mm BB bullets.

To achieve the above-described objective, a toy firearm with a replaceable cartridge loaded with BB bullets according to the present disclosure includes: a hollow firearm body; a cartridge module separably coupled in front of the firearm body to store a plurality of BB bullets to be fired; a gas discharge module to supply introduced gas to the BB bullets stored in the cartridge module in a manner of controlling simultaneous or sequential firing using a solenoid valve; an electrical sound module electrically connected to the gas discharge module to generate an electrical high voltage sound for a predetermined time with respect to a point in time of firing the BB bullets stored in the cartridge module; and a gas tank disposed in a grip of the firearm body to temporarily store the gas and supply the stored gas to the gas discharge module, wherein the cartridge module includes a pair of barrels arranged side by side at a predetermined angle along front and rear sides.

The electrical sound module includes a sound motor connected to a controller, a rotating cam coupled to a sound motor axis of the sound motor, a vibration plate which periodically vibrates by the rotation of the rotating cam and a sound casing to fix a side of the vibration plate and the sound motor.

The toy firearm with a replaceable cartridge loaded with BB bullets further includes a controller electrically connected to a trigger switch rotatably coupled to the firearm body, a safety lever switch and the gas tank, wherein the controller adjusts a velocity of the BB bullets and controls simultaneous firing and sequential firing by control of BB bullet firing data and firing and adjustment of an extent to which the solenoid valve is open or closed through a communication module, and the controller regulates the gas supply from the gas tank to the gas discharge module through detection of safety release of the safety lever switch and pivoting of the trigger switch for firing.

The cartridge module 20 has a 2 BB bullets loaded single shot or 6 BB bullets loaded revolver-type 3 round burst capability.

The gas tank includes a gas feed port at a bottom, a filter at a top and a gas flow pipe extended upward from the filter to the gas discharge module.

As described above, the toy firearm structure according to the present disclosure is configured such that the cartridge using BB bullets as projectiles is mounted, and in case of a BB bullet fired up, the cam and the vibration plate are mounted to simulate an electrical high voltage firing situation in which a high voltage is delivered for a predetermined time after firing.

The present disclosure significantly reduces the shooting cost considering a situation in which high shooting cost prohibits frequent training, thereby improving shooting skills through more shooting training.

The present disclosure makes it possible to conduct shooting training through images using, as a target, a monitor which detects a point of impact of a BB bullet, not a mannequin, thereby achieving a personal shooting training using a narrow space such as an indoor space.

The present disclosure can used to detect a point of impact after firing at a target in training wear using paintball 6 mm BB bullets.

The present disclosure can adjust the bullet velocity and control simultaneous firing and sequential firing by the control of BB bullet firing data and firing and the adjustment of the extent to which the electronic solenoid of the gas discharge module is open or closed through the communication module having a wireless method.

DETAILED DESCRIPTION

Figure 1:
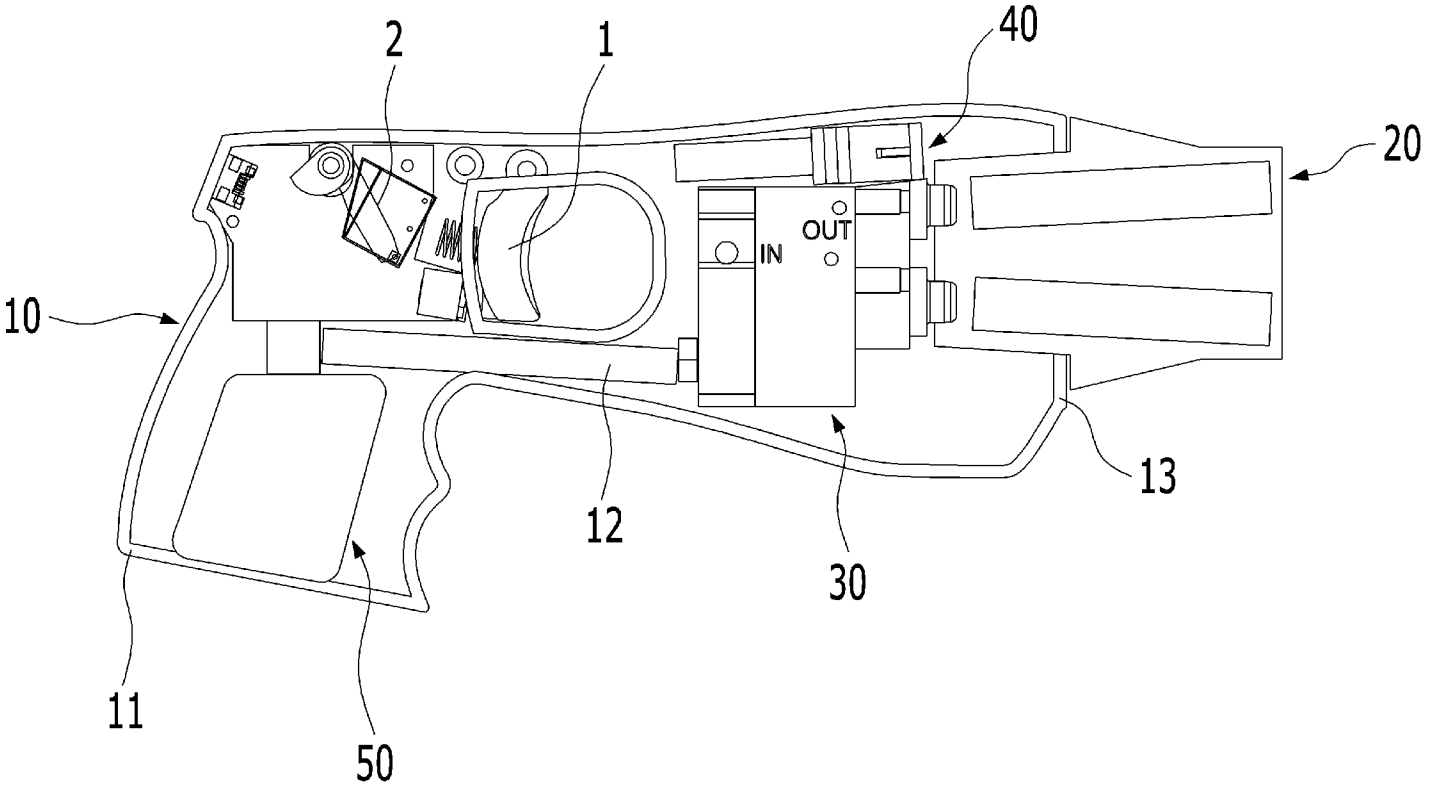
FIG. 1 shows an embodiment of the whole assembly configuration of a toy firearm with a replaceable cartridge loaded with BB bullets according to the present disclosure.

Hereinafter, the embodiments of the present disclosure will be described in more detail with reference to the accompanying drawings. However, the present disclosure is not limited to the following disclosed embodiments and will be embodied in a variety of different forms, and these embodiments are provided so that this disclosure will be thorough and complete, and will fully convey the scope of the present disclosure to those skilled in the art. In the drawings, like reference signs indicate like elements.

In adding the reference signs to the elements in each drawing, it should be noted that like elements have like reference signs as possible although they are shown in different drawings. Additionally, in describing the present disclosure, when it is determined that a certain detailed description of relevant known elements or functions may obscure the subject matter of the present disclosure, its detailed description is omitted.

Hereinafter, a toy firearm with a replaceable cartridge loaded with BB bullets according to an embodiment of the present disclosure will be described with reference to FIGS. 1 to 8.

The toy firearm with a cartridge includes a hollow firearm body 10 having a pistol shape; a cartridge module 20 separably coupled in front of the firearm body to store a plurality of BB bullets to be fired; a gas discharge module 30 to supply introduced gas to the BB bullets stored in the cartridge module in a manner of controlling simultaneous or sequential firing using a solenoid valve; an electrical sound module 40 electrically connected to the gas discharge module 30 to generate an electrical high voltage sound for a predetermined time with respect to the point in time of firing the BB bullets stored in the cartridge module 20; a gas tank 50 disposed in a grip of the firearm body 10 to temporarily store the gas and supply the stored gas to the gas discharge module 30; and a controller 60 electrically connected to a trigger switch 3 rotatably coupled to the firearm body 10, a safety lever switch 5 and the gas tank 50.

The present disclosure is characterized by regulating the gas supply from the gas tank 50 to the gas discharge module 30 through the detection of safety release of the safety lever switch 5 and pivoting of the trigger switch 3 for firing.

The cartridge module 20 may include a pair of barrels 23 arranged side by side at a predetermined angle along the front and rear sides within a cartridge casing 21 having a rectangular (2 bullets loaded) or cylindrical (revolver-type 6 bullets loaded revolving 3 round burst capability) shape.

Figure 2:
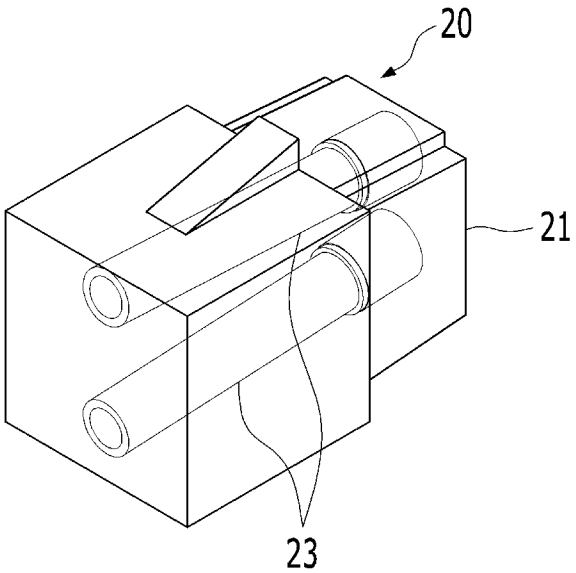
FIG. 2 shows an embodiment of a cartridge in a toy firearm with a replaceable cartridge loaded with BB bullets.
Figure 2:
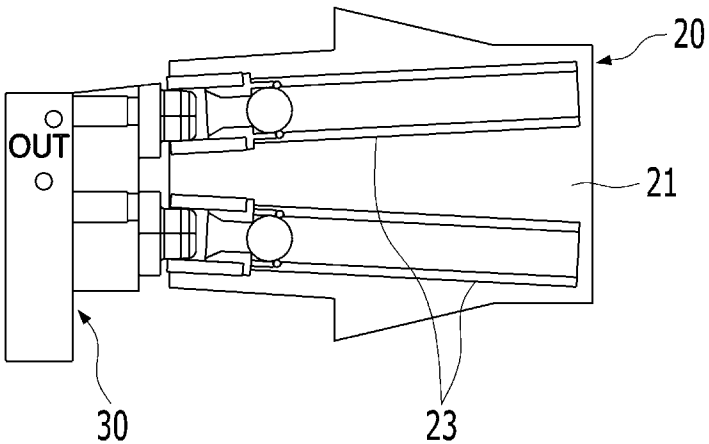
Figure 4:
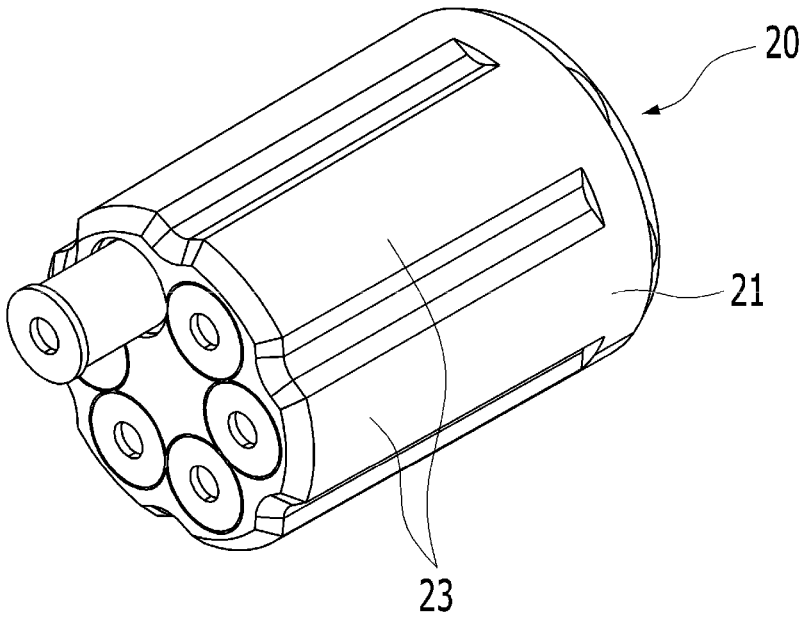
FIG. 4 shows another embodiment of a cartridge in a toy firearm with a replaceable cartridge loaded with BB bullets.
Figure 5:
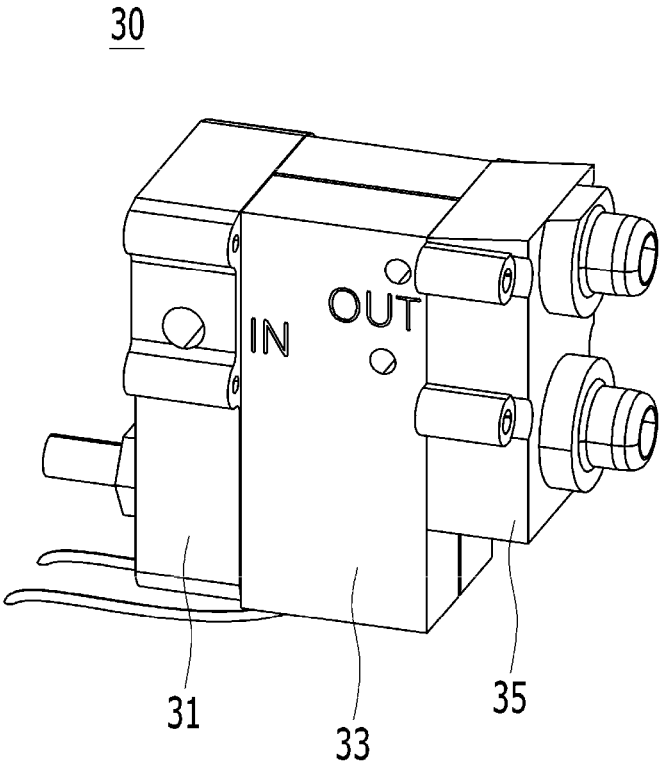
FIG. 5 shows a connection structure between a gas discharger and an electronic solenoid valve to fire a BB bullet.
Figure 6:
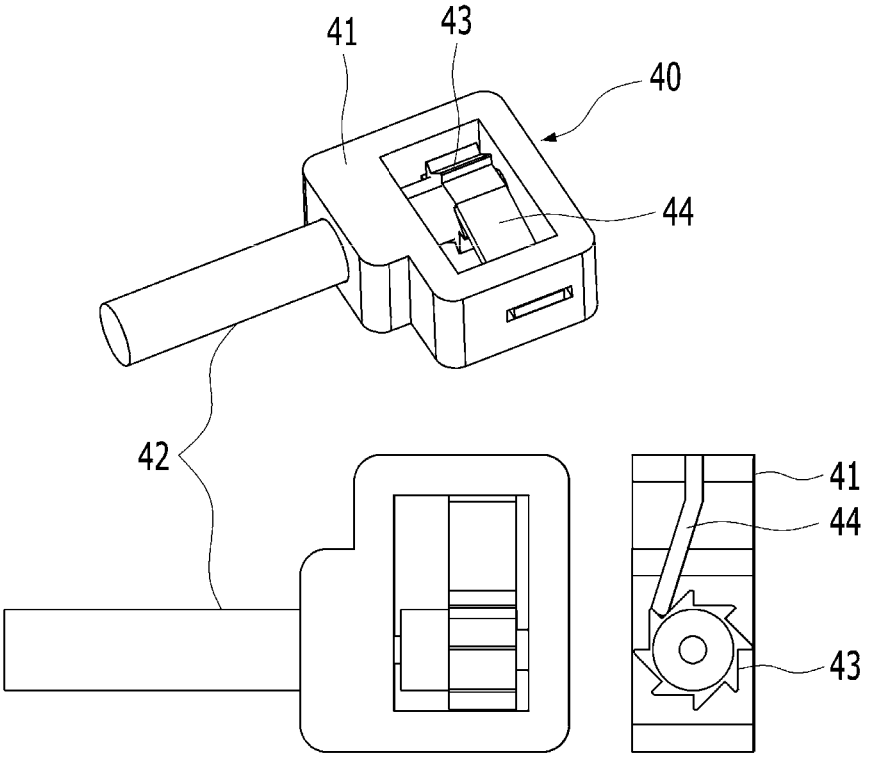
FIG. 6 shows an electrical sound generator which simulates an electrical high voltage sound by vibrating a vibration plate by the rotation of a motor coupled to a cam.
Figure 7:
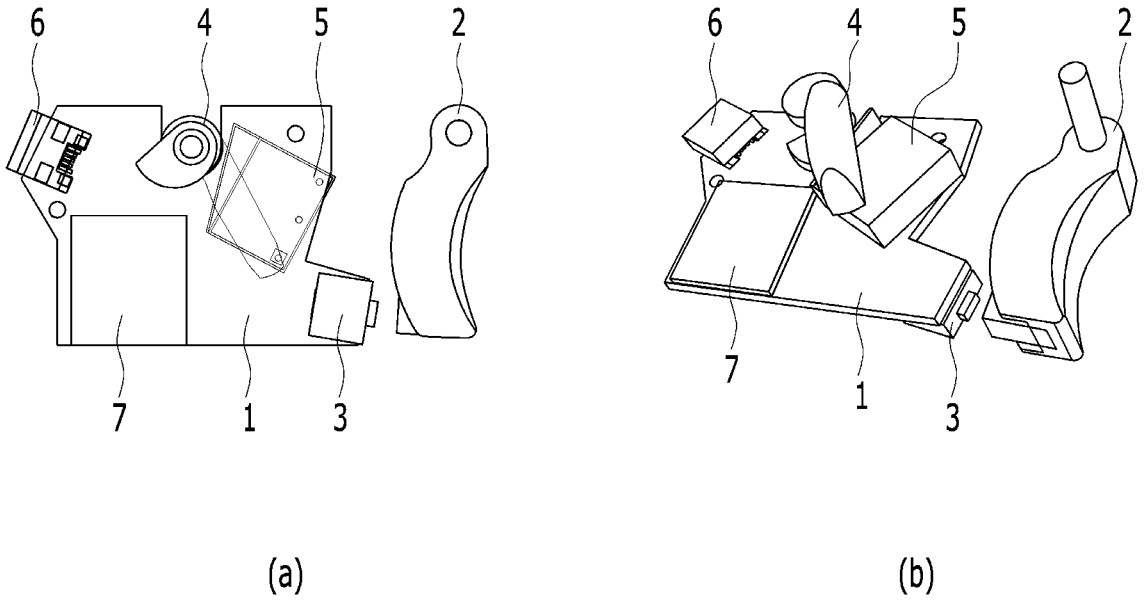
FIG. 7 shows a control relationship between a safety lever switch, a charger, a trigger switch and a wireless communication module through a controller.
Figure 8:
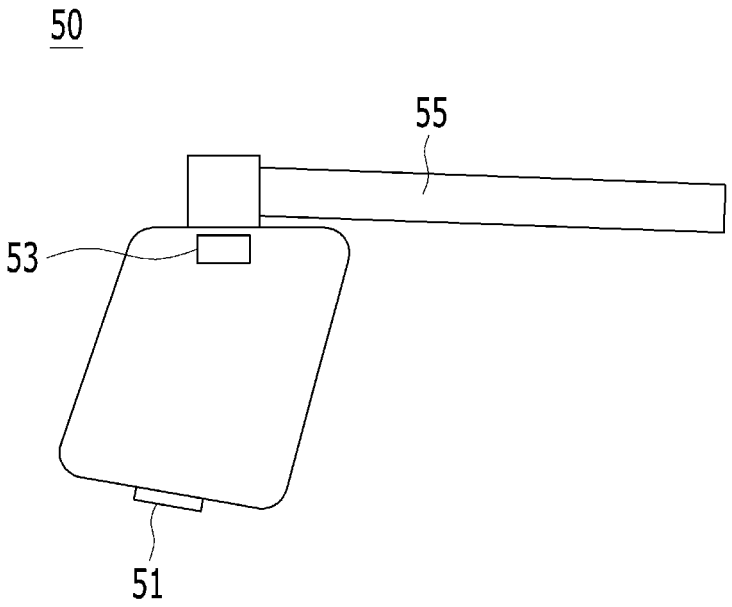
FIG. 8 shows a structure that stores gas through gas injection and expels gas using an electronic solenoid.

Referring to FIGS. 2 and 4, the cartridge module 20 is replaceably or fixedly coupled in front of the firearm body 10 in a generally rectangular shape. The pair of barrels 23 are arranged apart at an angle of 0° to 10° in the up-down direction within the cartridge casing 21, and each holds a single 6 mm BB bullet and fires using compressed air or high pressure gas. That is, the pair of barrels 23 include an upper barrel and a lower barrel, the upper barrel and the lower barrel (the gun barrel) fire the BB bullets simultaneously or sequentially, and in this instance, the upper barrel and the lower barrel (the gun barrel) are arranged at a fixed angle between 0° to 10° according to the range. The BB bullets are inserted in the pair of barrels 23 (the gun barrel) and then fired through gas vents.

Figure 3:
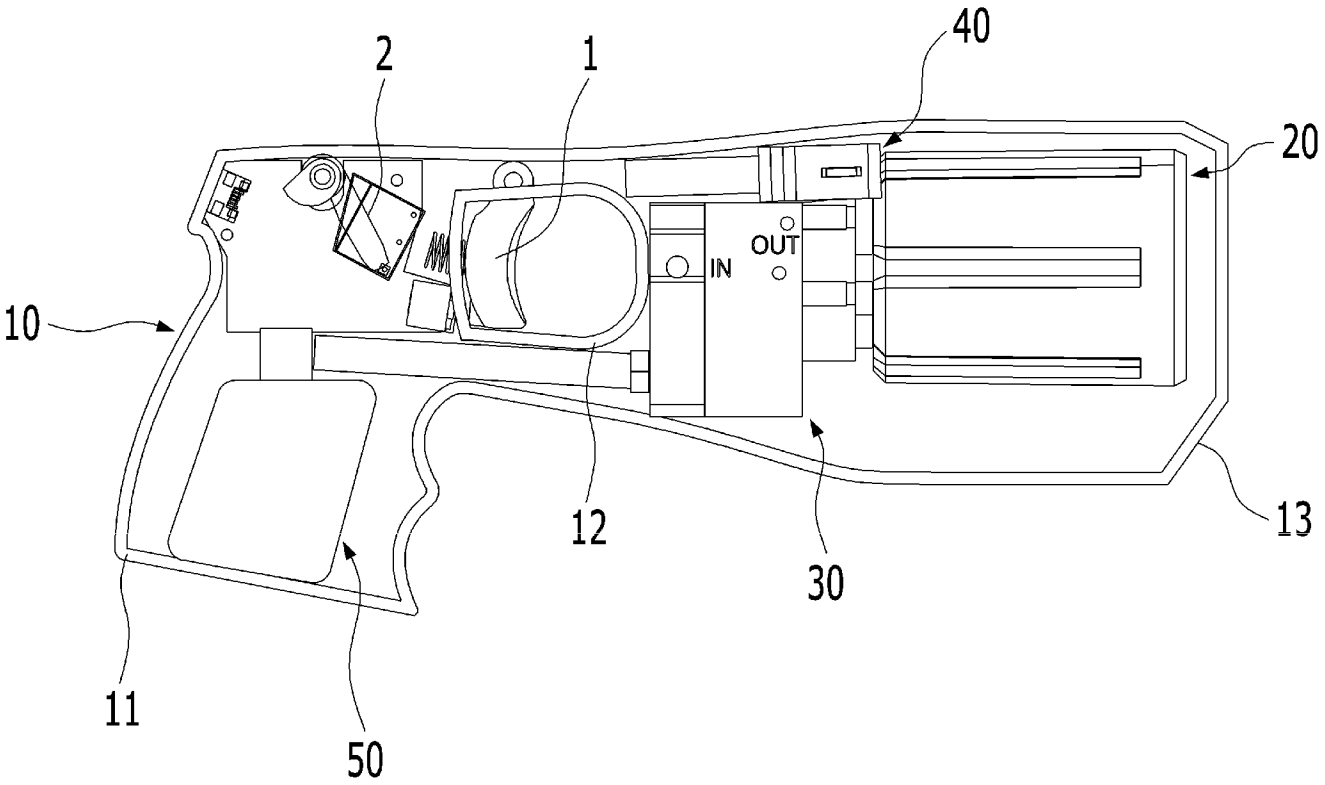
FIG. 3 shows another embodiment of the whole assembly configuration of a toy firearm with a replaceable cartridge loaded with BB bullets according to the present disclosure.

Referring to FIGS. 3 and 4, the pair of barrels 23 may be arranged at a predetermined angle along the front and rear sides within the cartridge casing 21 having a revolver-type 6 bullets loaded revolving 3 round burst capability, and the 6 mm BB bullets may be inserted into the barrels and then fired through the gas vents.

The gas discharge module 30 includes a gas inlet 31 connected to the gas tank 50, a solenoid valve 33 coupled to the exit of the gas inlet 31 and a gas outlet 35 connected to the solenoid valve 33 at a side and the barrel 23 of the cartridge module 20 at an opposite side. Two electronic solenoid valves 33 may be used to carry out solenoid control to instantaneously expel compressed air or gas, and the 6 mm BB bullets may be fired simultaneously or using a time difference by sequentially controlling the electronic solenoid valves 33.

The electrical sound module 40 includes a sound motor 42 connected to the controller 60, a rotating cam 43 coupled to a sound motor axis of the sound motor, a vibration plate 44 which periodically vibrates by the rotation of the rotating cam 43 and a sound casing 41 to fix a side of the vibration plate 44 and the sound motor.

The gas tank 50 includes a gas feed port 51 at bottom, a filter 53 at top and a gas flow pipe 55 extended upward from the filter to the gas discharge module.

The controller 60 is based on a controller substrate 1, and is electrically connected to the trigger switch 3 rotatably coupled to the firearm body 10, the safety lever switch 5 and the gas tank 50 to determine whether a safety lever 4 is in locked/unlocked position, the trigger 2 is activated/deactivated and there is sufficient remaining power through a charger 6 and allow the gas supply through the gas tank 50.

The controller 60 controls firing and firing signals and collects data using a communication module 7 mounted on the controller substrate 1. That is, the controller 60 may adjust the bullet velocity and control simultaneous firing and sequential firing by the control of BB bullet firing data and firing and the adjustment of the extent to the electronic solenoid of the gas discharge module 30 is open or closed through the communication module 7 having a wireless method. Additionally, the training effect may be maximized in conjunction with an electronic shooting monitor to detect the point of impact of the BB bullets.

The toy firearm structure according to the present disclosure as described above is configured such that the replaceable cartridge loaded with BB bullets is mounted after an electric shock device is removed, and in case of a BB bullet fired up, the cam and the vibration plate are mounted to simulate an electrical high voltage firing situation in which a high voltage is delivered for a predetermined time after firing.

The foregoing description is made to describe the technical spirit of the present disclosure for illustrative purposes, and it is obvious to those skilled in the art that a variety of modifications and change may be made thereto without departing from the essential features of the present disclosure. Therefore, the embodiments disclosed herein are provided to describe the technical spirit of the present disclosure and not intended to be limiting, and the technical spirit and scope of the present disclosure is not limited by the embodiments. The scope of protection of the present disclosure should be interpreted by the appended claims, and it should be interpreted that the scope of protection of the present disclosure covers all the technical spirit in the scope of the appended claims and equivalents thereof.

What is claimed is:

1. A toy firearm comprising:

a hollow firearm body;

a cartridge module separably coupled in front of the firearm body to store a plurality of BB bullets to be fired;

a gas discharge module to supply introduced gas to the BB bullets stored in the cartridge module in a manner of controlling simultaneous or sequential firing using a solenoid valve;

an electrical sound module electrically connected to the gas discharge module to generate an electrical high voltage sound for a predetermined time with respect to a point in time of firing the BB bullets stored in the cartridge module; and a gas tank disposed in a grip of the firearm body to temporarily store the gas and supply the stored gas to the gas discharge module, wherein the cartridge module includes a pair of barrels arranged side by side at a predetermined angle along front and rear sides.

2. The toy firearm according to claim 1, wherein the electrical sound module includes a sound motor connected to a controller, a rotating cam coupled to a sound motor axis of the sound motor, a vibration plate which periodically vibrates by the rotation of the rotating cam and a sound casing to fix a side of the vibration plate and the sound motor.

3. The toy firearm according to claim 1, further comprising:

a controller electrically connected to a trigger switch rotatably coupled to the firearm body, a safety lever switch and the gas tank, wherein the controller adjusts a velocity of the BB bullets and controls simultaneous firing and sequential firing by control of BB bullet firing data and firing and adjustment of an extent to which the solenoid valve is open or closed through a communication module, and wherein the controller regulates the gas supply from the gas tank to the gas discharge module through detection of safety release of the safety lever switch and pivoting of the trigger switch for firing.

4. The toy firearm according to claim 1, wherein the cartridge module has a 2 BB bullets loaded single shot or 6 BB bullets loaded 3 round burst capability.

5. The toy firearm according to claim 1, wherein the gas tank includes a gas feed port at a bottom, a filter at a top and a gas flow pipe extended upward from the filter to the gas discharge module.

6. The toy firearm according to claim 1, wherein the cartridge module is replaceably coupled in front of the firearm body.

* * * * *